United States Patent [19]

Erbe

[11] Patent Number: 4,488,765

[45] Date of Patent: Dec. 18, 1984

[54] DEAD-FACED ELECTRICAL CONNECTOR WITH ELECTROMAGNETIC VULNERABILITY PROTECTION

[75] Inventor: Alfred R. Erbe, Phoenix, Ariz.

[73] Assignee: The United States of America as represented by the Secretary of the Navy, Washington, D.C.

[21] Appl. No.: 160,697

[22] Filed: Jun. 18, 1980

[51] Int. Cl.[3] ..... H01R 13/44

[52] U.S. Cl. ..... 339/42; 339/111

[58] Field of Search ..... 339/40, 42, 111, 143

[56] References Cited

U.S. PATENT DOCUMENTS

| | | | |
|---|---|---|---|
| 3,360,764 | 12/1967 | Bac | 339/111 X |
| 3,491,326 | 1/1970 | Pfister et al. | 339/42 X |
| 3,729,699 | 4/1973 | Briggs et al. | 339/42 |
| 3,851,944 | 12/1974 | Ganzert et al. | 339/19 |
| 4,284,311 | 8/1981 | Forster et al. | 339/40 X |

*Primary Examiner*—Joseph H. McGlynn

*Attorney, Agent, or Firm*—Robert F. Beers; Ervin F. Johnston; Harvey Fendelman

[57] ABSTRACT

An electrical connector assembly is disclosed in which the receptacle components are shielded by an electromagnetic radiation mask and in which no power is present at the front end of the receptacle when the receptacle is not connected to its mating electrical plug. Intermediate electrical contacts in the receptacle portion of the connector assembly completely close apertures in the mask when the receptacle is not mated and are moved from the mask apertures and into contact with the internal electrical conductors of the receptacle when engaged with the male electrical plug portion of the assembly.

23 Claims, 3 Drawing Figures

DEAD-FACED ELECTRICAL CONNECTOR WITH ELECTROMAGNETIC VULNERABILITY PROTECTION

BACKGROUND OF THE INVENTION

The present invention relates generally to the field of electrical connectors and more particularly to mating electrical connectors and electrical plugs which may be advantageously employed in environments subject to electromagnetic radiation. For many years, electrical connectors have been built with metal shells and spring fingers and interference fits between shells have been used along with shielded cable to protect electrical circuits within the connectors from extraneous electromagnetic radiation (EMR) when the plug and receptacle of the connector set are mated. Protection of electrical circuits from stray EMR when the connector set is unmated has posed a problem in the past for which no adequate solution has been proposed. This condition is especially critical to electronic equipment in close proximity to radar or other transmitting equipment. Several methods have been used to provide this EMR protection to unmated connectors.

For instance, one such prior art connector includes a metal mask enclosing the insulator and socket contacts of the unmated connector receptacle with holes in the face of the mask to provide ingress of the plug pin contacts when mated. This receptacle design is based on waveguide technology where it is dependent on the length and diameter of the holes in the face of the electromagnetic protection masks to attenuate the extraneous signals. Such devices are generally only effective for large length-to-diameter ratios and becomes less effective at higher frequencies.

Another device that has been used in the past to protect against unwanted EMR utilizes mechanical doors that close over the face of the connector receptacle providing a metallic grounded shield around the electrical contacts. Such devices require considerable space for the doors and operating mechanism. Further, in these types of devices, it is very critical that good low resistance contact between the shell and doors is provided.

SUMMARY OF THE INVENTION

The present invention is designed to overcome the foregoing problems by providing an electrical connector and plug assembly with EMR protection where the EMR shield is entirely closed during the unmated condition of the receptacle and which does not rely on waveguide theory for attenuation of the unwanted EMR. Further, this is accomplished in a device that has relatively few parts, is relatively easy to manufacture and consequently may be mass produced at low cost.

The electrical connector assembly disclosed herein is further considered to be a significant improvement over prior art connector assemblies in that in the unmated condition of the receptacle, the receptacle is "dead-faced", i.e. there is no power present at the terminals at the front face of the receptacle when the receptacle is in the unmated condition. The connector assembly disclosed herein is further believed to be entirely suitable for underwater applications and environments where the receptacle would be susceptible to contamination and malfunction by foreign objects such as dust or sand.

The benefits achieved by the present invention are accomplished by providing a receptacle with an EMR mask that substantially entirely encloses the electrical connectors of the receptacle and that has apertures in the front face thereof for permitting ingress of the male pin contact of the mating electrical plug. The apertures in the front face of the EMR mask are entirely closed off during the unmated condition of the receptacle by intermediate contacts within the receptacle which are mechanically biased to cover these apertures. Further, these intermediate contacts are disconnected from the electrical conductors of the receptacle which may carry electrical power. The front face of the electrical receptacle is thereby "dead-faced." The electrical plug of the present invention is provided with male pin contacts which align during mating with the corresponding apertures in the front face of the receptacle. The electrical plug is further provided with an actuating pin that extends further from the plug than do the male pin contacts. During mating, this actuator mechanism passes through one of the apertures in the front face of the EMR mask of the receptacle and is received by an actuator response insulating assembly which reacts to withdraw the intermediate contacts from the apertures of the receptacle to permit ingress of the male pin contacts of the plug and which further reacts to bring the intermediate contacts into electrical connection with the electrical conductors of the receptacle and into electrical connection with the male pin contacts of the electrical plug.

By grounding the intermediate contacts to the EMR mask, the present invention effectively totally encloses the electrical conductors of the receptacle and circuits with a metal mask which provides a shield to EMR with minimum space requirements and a simple actuating mechanism. This method when compared to the waveguide type mask provides much greater attenuation especially at higher frequencies. Comparing this invention to the hinged door design described above, the mechanical actuation is much simpler. less space is required and the method of providing electrical shielding to the circuits is more effective and less sensitive to dimensional tolerances.

OBJECTS OF THE INVENTION

Accordingly, it is the primary object of the present invention to disclose an improved electrical receptacle and plug assembly having EMR protection of its internal electrical parts.

It is a concomitant object of the present invention to disclose an improved electrical receptacle and plug assembly in which the electrical receptacle is "dead-faced" when such receptacle is not mated with the corresponding plug.

It is a further object of the present invention to disclose an improved electrical receptacle and plug assembly in which the receptacle is both "dead-faced" and has EMR protection of its internal parts.

It is an additional object of the present invention to disclose an improved electrical connector assembly that has a minimal number of parts, is easy to manufacture and is more effective and less sensitive to dimensional tolerances than prior art devices.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
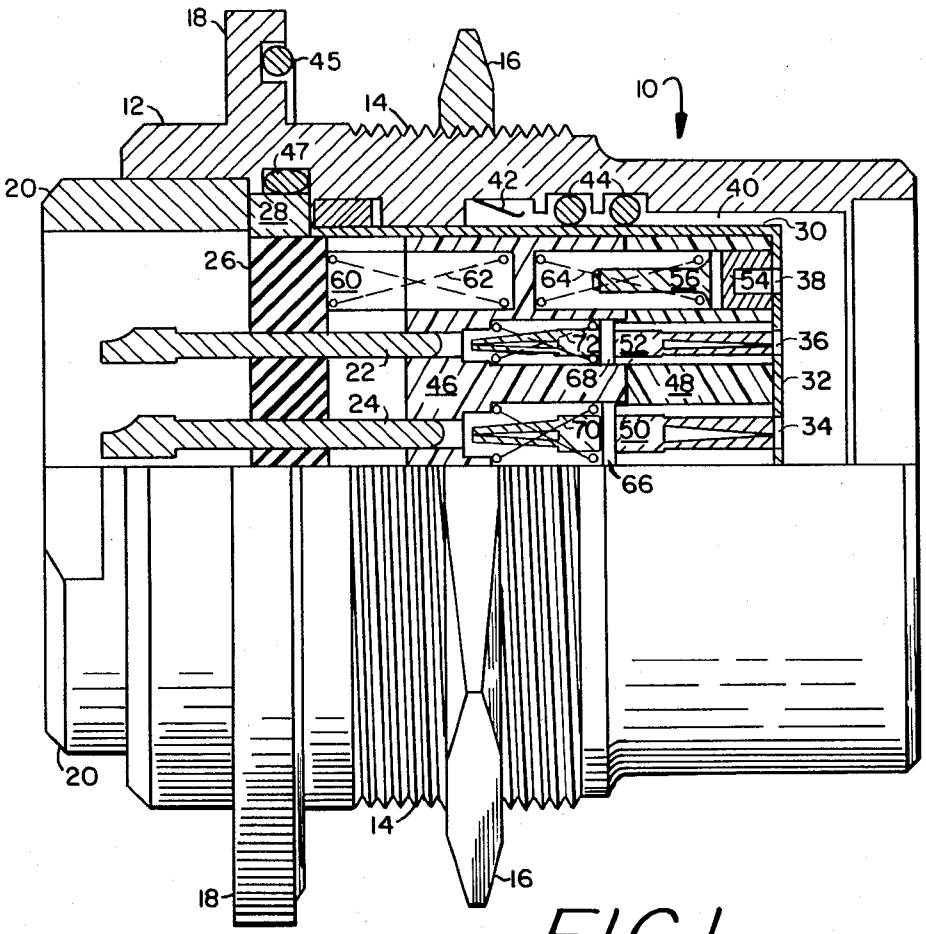
FIG. 1 is a side view with partial cross section of the novel electrical receptacle of the present invention.

Referring now to FIG. 1, the receptacle portion of the connector assembly of the present invention will be described. The receptacle 10 in its preferred embodiment is generally cylindrically shaped having an outer hollow, cylindrical, metallic shell assembly 12. The shell assembly 12 may be provided with threaded portions 14, a jam nut 16 and flange 18 for attachment to a chasis or the like. The shell assembly 12 is fitted to the hollow, metallic cylindrical insert retaining ring 20. Pin contacts and 22 and 24 are supported by the hermetic insulating insert pin assembly 26 of a generally disc shaped design with apertures therein for containing the pin contacts 22 and 24.

The insulating insert pin assembly 26 is contained within the shell assembly 12 by rear flange portion 28 of the EMR mask 30. The EMR mask 30 is snugly secured within the shell assembly 12 and in the preferred embodiment is of generally cup shape design having a front portion 32 which forms a substantially closed end at the front end of the receptacle 10. Apertures 34, 36 and 38 are provided in the substantially closed end 36 of the EMR mask 30 for receiving the male pin contacts of the plug to be described. The EMR mask 30, via flange portion 28 is in electrical contact with the metallic insert retaining ring 20 which likewise is in electrical contact with the metallic shell assembly 12. A continuous electrical connection is thereby provided between the EMR mask 30 and the metallic shell assembly 12 which, in the preferred embodiment, is intended to be connected to ground potential. As is apparent from the illustration in FIG. 1, the receptacle socket pin contacts 22 and 24 are substantially enclosed by the metallic shell assembly 12 and the metallic insert retaining ring 20. By complete closure of the apertures 34, 36, and 38 by the metallic electrical conductive members to be described below in the EMR mask 30 and by grounding of the EMR mask 30 through the metallic insert retaining ring 20 and the metallic shell assembly 12, a complete EMR shield is provided around the socket pin contacts 22 and 24 as well as the other contact members contained within the mask 30 to be described below.

As is seen in FIG. 1, an annular channel 40 is provided between the EMR mask 30 and the metallic shell assembly 12. The annular channel 40 enables insertion of the plug member of the electrical connector of the present invention into the receptacle and enables alginment and snug fit therewith. RFI spring 42 is mechanically and electrically connected to the shell assembly 12 and extends sufficiently far into the interior of the shell assembly 12 to ensure good electrical contact with the plug member of the connector assembly to be described. O-rings 44 are provided as illustrated to ensure weather sealing between the receptacle and plug members of the connector of the present invention. Likewise, O-ring 45 may be provided on flange member 18 to enable weather sealing of the shell assembly 12 against a chassis.

Turning now to the internal components contained within the EMR mask 30, it is seen in FIG. 1 that there is fitted within the EMR mask 30, a two-piece socket insulator assembly comprised of components 46 and 48. The components 46 and 48 are grooved and fit together in sandwich-like manner to form several channels for containing the socket pin contacts 22 and 24 and to permit slidable engagement of the socket insulator assembly 46, 48 with the contacts 22 and 24 as is apparent from the illustration in FIG. 1. Further, the two-piece socket insulator assembly 46, 48 has channels formed therebetween for containment of and slidable engagement with the intermediate contact members 50 and 52 described further below. Additional channels are formed in the socket insulator assembly 46, 48 for containment of and slidable engagement with the socket actuating hub 54 and the socket actuating pin 56 connected to the hub 54. Also, channel 60 is formed between the socket insulator assembly parts 46 and 48 for containment of the insulator return spring 62.

The socket actuating hub 54 is metallic and generally cup shaped with a sufficiently large diameter to completely cover the aperture 38 in the closed end 32 of the EMR mask 30. The open end of the cup shaped actuating socket 54 faces towards the front of the receptacle and is designed to receive the actuating mechanism of the plug member of the electrical connector of the present invention to be described below. A helical actuating spring 64 surrounds the actuating pin 56 and is secured within the socket insulator assembly 46, 48 and abuts against and exerts pressure on the left end of the actuating socket 54. The actuating spring 64 thus biases the actuating socket 54 towards the front end of the receptacle to ensure that the aperture 38 is completely closed during the unmated condition of the receptacle.

Intermediate electrical contact members 50 and 52 are double ended, front end sleeved contacts. Further, each end of each of the double ended intermediate contacts 50 and 52 is a two pronged contact in which the prong pairs are spring biased together for engagement with pin contacts as is well known. The outer ends of each of the two pronged contacts on each end of the intermediate contacts 50 and 52 are preferably chamfered (not shown) to guide and permit entry of pin contacts. Also, each of the intermediate contact members 50 and 52 is provided with an integral annular collar 66 and 68, respectively. It is important that the sleeves on the right end of the intermediate contacts 50 and 52 are of sufficiently large radial dimension so as to ensure complete and continuous closure of the apertures 34 and 36. Closure of the apertures 34 and 36 by the intermediate contacts 50 and 52 and closure of the aperture 38 by the actuating socket 54 creates a continuous closed metal surface at the closed end 32 of the EMR mask 30. This complete closure of the apertures 34, 36 and 38 in the EMR mask prevents unwanted electromagnetic radiation from entering through the front face of the receptacle 10.

Helical contact loading spring 70 and helical contact loading spring 72 are secured within the insulator assembly 46, 48 and abut against and exert pressure against the annular collars 66 and 68, respectively, of the intermediate contacts 50 and 52, respectively. The spring members 70 and 72 thus bias the intermediate contacts 50 and 52, respectively, towards the front face of the receptacle and maintain closure of the apertures 34 and 36 during the unmated condition of the receptacle. From the illustration in FIG. 1, it is apparent that the socket pin contacts 22 and 24 are electrically disconnected from the intermediate contacts 50 and 52 during the unmated condition of the receptacle. Since pin contacts 22 and 24 may carry power, this feature whereby the intermediate contacts 50 and 52 are disconnected from the pin contacts 24 and 22 during the unmated condition of the receptacle, ensures that the front face of the receptacle is "dead-faced", i.e. no power is present at the front face of the receptacle during the unmated condition of the receptacle. It is further noted that the insulator return spring 62 provided within channel 60 biases the insulator assembly 46, 48 towards the front face of the receptacle during the unmated condition. Under the bias of insulator return spring 62 against the insulator assembly 46, 48 and further under the bias provided by the helical springs 70 and 72 as well as the actuating spring 64, the entire insulator assembly 46, 48 and the actuating socket 54 as well as the contact members 50 and 52 completely close the apertures 34, 36 and 38 thereby providing EMR protection for the components contained within the mask 30. It is further noted that by reason of the alignment of the longitudinal axes of the pins 22 and 24 with the longitudinal axes of the intermediate contacts 52 and 50, respectively, that good electrical connection between the described contact members is enabled.

Figure 2:
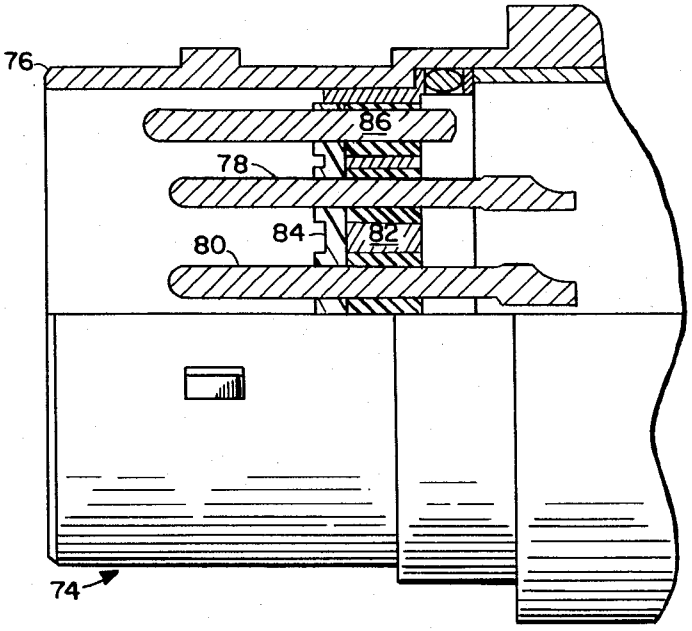
FIG. 2 is a side view with partial cross section of the electrical plug of the present invention.

Referring now to FIG. 2 the plug member 74 of the electrical connector of the present invention will be described. The plug member 74 includes an outer metallic shell 76 which is of hollow cylindrical design and appropriate dimension to permit entry thereof into channel 40 of the receptacle 10 and proper alignment and engagement with the receptacle 10. Male pin contacts 78 and 80 are mounted within the metallic shell 76 by means of hermetic pin insert insulating assembly 82. Interfacial seal 84 is also provided. Also supported by the hermetic pin insert assembly 82 is the actuator mechanism 86 in the form of a metallic pin which extends further from the front face of the plug 74 than do the male pin contacts 78 and 80.

Figure 3:
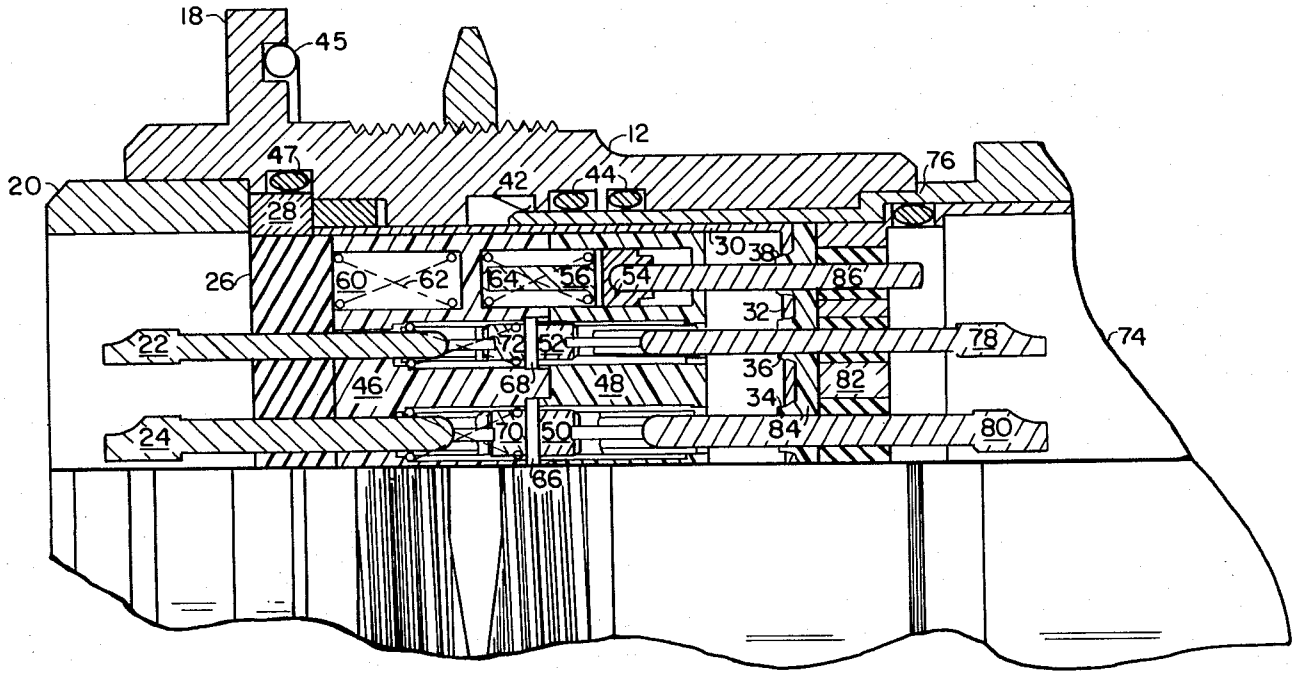
FIG. 3 is a cross-sectional view of the electrical receptacle and electrical plug in accordance with the present invention in the engaged position.

The engaged position of the receptacle 10 and plug 74 of the electrical connector of the present invention is illustrated in FIG. 3 and will now be described. As the plug 74 and the receptacle engage, the actuating pin 86 of the plug 74 enters the aperture 38 and engages the actuating socket 54 to move the socket insulator assembly 46, 48 via the actuating pin 56 away from the closed end 32 of the EMR mask 30. Since the insulator assembly 46, 48 carries the intermediate contacts 50 and 52, when the insulator assembly 46, 48 is thus moved to the rear portion of the receptacle, the right contact end of the intermediate contacts 50 and 52 are pulled away from the apertures 34 and 36, thereby opening such apertures and permitting entry of the male pin contacts 78 and 80. The ground connection between the intermediate contacts 50 and 52 through the EMR mask 30 is thus opened as the insulator continues to travel to the left end of the receptacle as illustrated in FIG. 3. The contact engaging forces and the insulator return spring 62 overcome the force of the actuating socket spring 64 causing the actuating pin 56 to bottom on the insulator assembly 46, 48. Continued travel of the actuator pin 86 fully mates the pin contacts 78 and 80 with the intermediate contact 52 and 50, respectively, and further fully mates the intermediate contacts 50 and 52 with the receptacle pin contacts 24 and 22, respectively. Further, sealing of O-rings 44 between the receptacle shell 12 and the plug shell 76 and the RFI spring 42 is engaged by the metallic shell 76 of the plug assembly 74.

The unmating operating sequence of the plug 74 and the receptacle of the present invention is as follows. As the plug 74 and the receptacle 10 are disengaged, the actuating socket 54 moves with the plug 74 travel to the right. As the actuating spring 64 force decreases, the insulator return springs 62 move the insulator assembly 46, 48 to the unmated position illustrated in FIG. 1. The design of the insulator return spring 62, the design and spacing of the actuator pin 56 from the insulator assembly 46, 48 and the design of the actuating spring 64 are such that the receptacle pin contacts 22 and 24 and intermediate contacts 50 and 52 as well as the plug pin contacts 78 and 80 are fully disengaged prior to contact with the EMR mask 30 by the intermediate contacts 50 and 52.

It is to be understood that within the scope of the present invention, the embodiments illustrated in FIGS. 1–3 may be modified in various respects. For instance, the receptacle member 10 of the connector of the present invention need not include an outer metallic casing such as casing 12 illustrated in FIG. 1. The EMR mask also serve as the outer casing of the receptacle. Nor need the receptacle and plug be of cylindrical design. They may be implemented instead with rectangular or other shaped cross sections. The invention is also not limited to connectors containing two conductors. The connector within the scope of the present invention may have only one interior conductor such as in a coaxial cable or it may include more than two conductors. Moreover, other types of intermediate contact members than the double-ended two-pronged type illustrated in the drawings may be used. For instance, butt contact connectors could be used with appropriate modification to the bias springs and insulator assembly.

Obviously, many other modifications and variations of the present invention are possible in the light of the above teachings. It is therefore to be understood that within the scope of the appended claims, the invention may be practiced otherwise than as specifically described.

What is claimed is:

1. In an electrical connector of the type wherein an electric current is continued over n conductor paths, where n is an integer, through engaged contacts of a mated electric plug and receptacle, in said receptacle, the improvement comprising:

a metallic encasement having a metallic generally closed end and a rear portion, said metallic closed end having n+1 apertures therein for providing ingress of n male pin contacts and an actuator means;

n electrical conductors mounted within said encasement and substantially enclosed thereby;

a movable insulator assembly supported in said metallic encasement;

n intermediate electrical contacts supported by said insulator assembly and aligned with said n apertures;

means for biasing said insulator assembly towards said generally closed end when said receptacle is unmated from said electric plug such that said n apertures are covered and closed by said n intermediate contacts to completely close said generally closed end and such that said n electrical conductors are disconnected from said n intermediate contacts; and means responsive to ingress of said actuator means within said metallic encasement for moving said insulator assembly towards said rear portion such that said n intermediate contacts electrically connect with said n electrical conductors.

2. The improved receptacle of claim 1 wherein said metallic encasement is generally cup shaped.

3. The improved receptacle of claim 1 wherein the longitudinal axis of each of said n electrical conductors is longitudinally aligned w1th the longitudinal axis of one of said n intermediate electrical contacts.

4. The improved receptacle of claim 3 wherein n=2.

5. The improved receptacle of claim 1 wherein said movable insulator assembly comprises first and second assembly members each having grooves therein and cooperating in a sandwich-like manner to form n channels therein such that each of said n intermediate electrical contacts is slideably positioned in one of said n channels.

6. The improved receptacle of claim 5 wherein said n channels of said movable insulator assembly are longitudinally aligned with and slideably engageable with said n electrical conductors such that during mating of said receptacle with said electric plug each of said n electric conductors makes electrical connection with one of said n intermediate contacts.

7. The improved receptacle of claim 6 wherein each of said n intermedite electrical contacts is a double ended contact having first and second ends so as to enable electrical contact at said first end with one of said n male pin contacts and to enable electrical contact at said second end with one of said n electrical conductors.

8. The improved receptacle of claim 5 further comprising:

actuator response means secured to said insulator assembly for responding to ingress of said actuator means for causing said insulator assembly to move towards said rear portion to thereby engage said n intermediate contacts with said n electrical conductors.

9. The improved receptacle of claim 8 wherein said actuator response means comprises:

a socket member for receiving said actuator means; and an actuator response rod connected to said socket member.

10. In an electrical connector of the type wherein an electric current is continued over n conductor paths, where n is an integer, through engaged contacts of a mated electric plug and receptacle, in said receptacle, the improvement comprising:

a metallic encasement having a metallic generally closed end and a rear portion, said metallic closed end having apertures therein for providing ingress of n male pin contacts and an actuator means;

n electrical conductors mounted within said encasement and substantially enclosed thereby;

a movable insulator assembly supported in said metallic encasement;

n intermediate electrical contacts supported by said insulator assembly and aligned with said n apertures;

means for biasing said insulator assembly towards said generally closed end when said receptacle is unmated from said electric plug such that said n apertures are covered and closed by said n intermediate contacts to completely close said generally closed end and such that said n electrical conductors are disconnected from said intermediate contacts;

means responsive to ingress of said actuator means within said metallic encasement for moving said insulator assembly towards said rear portion such that said n intermediate contacts electrically connect with said n electrical conductors;

said movable insulator assembly comprising first and second assembly members each having grooves therein and cooperating in a sandwich-like manner to form n channels therein such that each of said n intermediate electrical contacts is slideably positioned in one of said n channels;

actuator response means secured to said insulator assembly for responding to ingress of said actuator means for causing said insulator assembly to move towards said rear portion to thereby engage said n intermediate contacts with said n electrical conductors, said actuator response means comprising a socket member for receiving said actuator means and an actuator response rod connected to said socket member; and said insulator assembly further including an actuator response channel for supporting therein said socket member and said actuator response rod and for permitting said actuator response means to move within said insulator assembly.

11. The improved receptacle of claim 10 further comprising:

actuator response bias means for biasing said actuator response means towards said generally closed end.

12. The improved receptacle of claim 11 wherein said actuator response means and said means for biasing said insulator assembly cooperate when said receptacle is being unmated from said plug to prevent said n intermediate contacts from closing said n apertures prior to electrical disconnection of said n electrical conductors from said n intermediate contacts.

13. The receptacle of claim 12 further comprising a metallic shell substantially enclosing and in electrical contact with said metallic encasement.

14. The receptacle of claim 13 wherein said means for biasing said insulator assembly comprises a spring.

15. The receptacle of claim 14 further comprising: intermediate connector spring means each being mechanically coupled to one of said n intermediate contacts and to said movable insulator assembly for urging said intermediate contacts towards said front face.

16. A dead faced electrical connector assembly having electromagnetic radiation protection comprising:

a receptacle for mating with a corresponding electric plug, said receptacle comprising a metallic encasement having a metallic generally closed end and a second end, said closed end having at least two apertures therein for providing ingress of at least one male pin contact and an actuator means;

a movable insulator assembly disposed within said metallic casing;

at least one intermediate electrical contact supported by said insulator assembly;

an actuator response means supported by said insulator assembly for responding to ingress of said actuator means for causing said insulator assembly to move towards said second end;

means for biasing said insulator assembly towards said closed end such that each of said at least one intermediate contacts electrically connects with and forms a continuous closure of one of said at least two apertures and such that said actuator response means forms a continuous closure of one of said at least two apertures when said receptacle is not mated with said plug.

17. The assembly of claim 16 further comprising:

an electrical plug comprising a metallic casing for releasable engagement with said metallic encasement of said receptacle;

at least one male pin contact supported in and extending from said metallic casing; and an actuator means supported in and extending from said metallic casing.

18. A dead faced electrical connector assembly having electromagnetic radiation protection comprising:

a receptacle for mating with a corresponding electric plug, said receptacle comprising a metallic encasement having a metallic generally closed end and a second end, said closed end having at least two apertures therein for providing ingress of at least one male pin contact and an actuator means;

a movable insulator assembly disposed within said metallic casing;

at least one intermediate electrical contact supported by said insulator assembly;

an actuator response means supported by said insulator assembly for responding to ingress of said actuator means for causing said insulator assembly to move towards said second end;

means for biasing said insulator assembly towards said closed end such that each of said at least one intermediate contacts electrically connects with and forms a continuous closure of one of said at least two apertures and such that said actuator response means forms a continuous closure of one of said at least two apertures when said receptacle is not mated with said plug;

an electrical plug comprising a metallic casing for releasable engagement with said metallic encasement of said receptacle;

at least one male pin contact supported in and extending from said metallic casing;

an actuator means supported in and extending from said metallic casing;

said actuator means comprising a pin contact extending further from said metallic casing than said at least one male pin contact.

19. The assembly of claim 18 further comprising:

at least one electrical conductor disposed within said receptacle metallic encasement and aligned along the longitudinal axis thereof with the longitudinal axis of said at least one intermediate electrical contact.

20. An electrical plug for connection and mating with an electrical receptacle comprising:

a metallic casing for releasable engagement with said receptacle;

at least one male pin contact supported in and extending from said metallic casing; and an actuator means supported in and extending from said metallic casing further than said at least one male pin contact for ingress into said receptacle prior to ingress of said at least one male pin.

21. The improved receptacle of claim 1 wherein said encasement is entirely metallic.

22. In an electrical connector of the type wherein an electric current is contained over n conductor paths, where n is an integer, through engaged contacts of a mated electric plug and receptacle, in said receptacle, the improvement comprising:

a metallic encasement having a metallic generally closed end and a rear portion, said metallic end having n+1 apertures therein for providing ingress of n male pin contacts and an actuator means;

n electrical conductors mounted within said encasement and substantially enclosed thereby;

a movable insulator assembly supported in said metallic encasement;

n intermediate electrical contacts supported by said insulator assembly and aligned with said n apertures;

means for biasing said insulator assembly towards said generally closed end when said receptacle is unmated from said electric plug such that said n apertures are covered and closed by said n intermediate contacts to completely close said generally closed end and such that said n electrical conductors are disconnected from said n intermediate contacts;

means responsive to ingress of said actuator means within said metallic encasement for moving said insulator assembly towards said rear portion such that said n intermediate contacts electrically connect with said n electrical conductors; and said n intermediate electrical contacts each having a distinct mated and unmated position, each of said n intermediate contacts being in contact with said metallic encasement metallic generally closed end when in said unmated position.

23. In an electrical connector of the type wherein an electric current is continued over n conductor paths, where n is an integer, through engaged contacts of a mated electric plug and receptacle, in said receptacle, the improvement comprising:

a metallic encasement having a metallic generally closed end and a rear portion, said metallic closed end having n+1 apertures therein for providing ingress of n male pin contacts and an actuator means;

n electrical conductors mounted within said encasement and substantially enclosed thereby;

a movable insulator assembly supported in said metallic encasement, said movable insulator assembly being movable with respect to said metallic closed end;

n intermediate electrical contacts supported by said insulator assembly and aligned with said n apertures;

means for biasing said insulator assembly towards said generally closed end when said receptacle is unmated from said electric plug such that said n apertures are covered and closed by said n intermediate contacts to completely close said generally closed end and such that said n electrical conductors are disconnected from said n intermediate contacts; and means responsive to ingress of said actuator means within said metallic encasement for moving said insulator assembly towards said rear portion such that said n intermediate contacts electrically connect with said n electrical conductors.

* * * * *